United States Patent [19]

Scanlon et al.

[11] Patent Number: 4,832,118

[45] Date of Patent: May 23, 1989

[54] HEAT EXCHANGER

[75] Inventors: John F. Scanlon, Roscoe; Shawn A. Warner; Alan D. Bengtson, both of Rockford, all of Ill.

[73] Assignee: Sundstrand Corporation, Rockford, Ill.

[21] Appl. No.: 934,496

[22] Filed: Nov. 24, 1986

[51] Int. Cl.[4] ..... F28D 7/02; F28F 1/42

[52] U.S. Cl. ..... 165/164; 165/179; 165/905

[58] Field of Search ..... 165/164, 185, 905, 179

[56] References Cited

U.S. PATENT DOCUMENTS

| | | | |
|---|---|---|---|
| 3,299,634 | 1/1967 | Layelbauer | 60/266 X |
| 3,413,239 | 11/1968 | Olstowski et al. | 165/905 X |
| 3,534,908 | 10/1970 | Coleman et al. | 60/266 X |
| 3,648,461 | 3/1972 | Bailey et al. | 60/266 X |
| 3,710,572 | 1/1973 | Hervel | 60/266 X |
| 3,819,334 | 6/1974 | Yoshida et al. | 165/179 X |
| 3,912,003 | 10/1975 | Schrade | 165/179 X |
| 3,913,666 | 10/1975 | Bayliss | 165/185 X |
| 4,118,262 | 10/1978 | Abbott | 156/175 |
| 4,134,451 | 1/1979 | Conant et al. | 165/133 |
| 4,168,743 | 9/1979 | Arai et al. | 165/905 |
| 4,355,684 | 10/1982 | Caines | 165/154 |
| 4,432,408 | 2/1984 | Caines | 165/154 |
| 4,471,837 | 9/1984 | Larson | 165/185 |
| 4,474,233 | 10/1984 | Swozil | 165/184 |
| 4,496,621 | 1/1985 | Hubert et al. | 428/236 |
| 4,515,847 | 5/1985 | Taverna et al. | 428/107 |
| 4,534,886 | 8/1985 | Kraus et al. | 252/502 |
| 4,577,678 | 3/1986 | Frauenfeld et al. | 165/405 X |
| 4,603,731 | 8/1986 | Olsen | 165/86 X |

*Primary Examiner*—Ira S. Lazarus
*Assistant Examiner*—Peggy Neils
*Attorney, Agent, or Firm*—Wood, Dalton, Phillips, Mason & Rowe

[57] ABSTRACT

A heat exchanger is illustrated in the form of a pair of juxtaposed chambers defining a first flow path for passing a heated fluid therethrough and a second flow path for passing a cooling medium therethrough. A heat exchanging structure extends between the first and second flow paths in communication therewith. The heat exchanging structure includes at least one composite of thermally conductive fibrous material laid up unidirectionally in a direction between the flow paths for transferring heat from the heated fluid in the first flow path for absorption by the cooling medium in the second flow path.

19 Claims, 1 Drawing Sheet

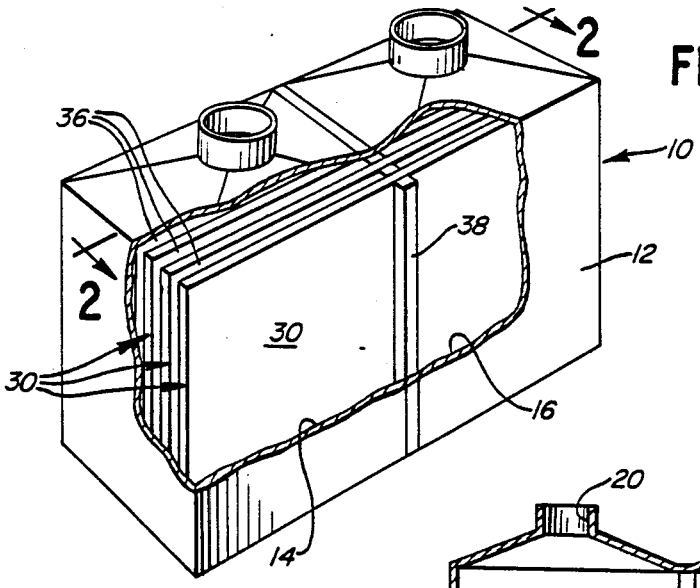
FIG. 1
FIG. 2
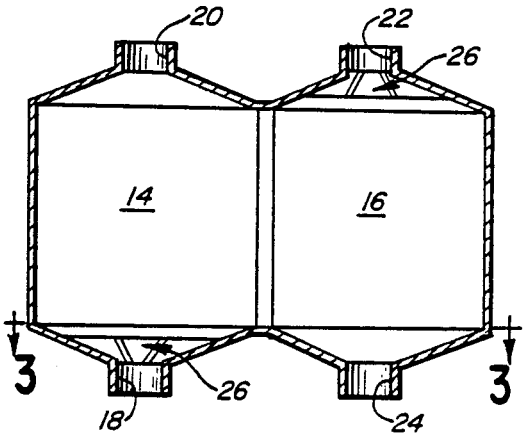
FIG. 3
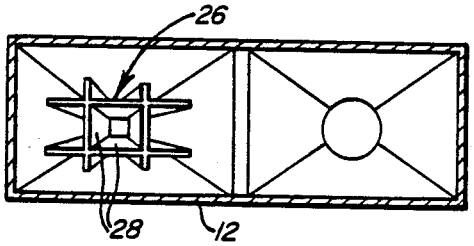
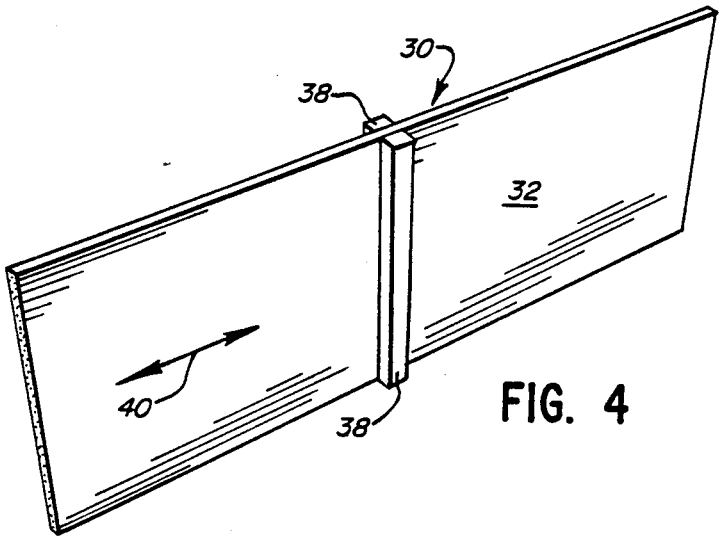
FIG. 4

HEAT EXCHANGER

DESCRIPTION

1. Field of the Invention

This invention generally relates to heat exchangers and, particularly, to a novel heat exchanger using fibrous material such as graphite or the like.

2. Background of the Invention

Heat exchangers have been used in a wide range of applications ranging from common and long known condenser tubes in boilers to modern day, sophisticated electronic and aerospace applications. Early heat exchangers conventionally used metal components, such as copper rods or copper tubing, for transferring heat from one area or location to another or for flowing a cooling medium through the tubing. Metal, such as copper or the like, was used because of its high thermal conduction.

When heat is to be exchanged between fluids which are at high temperatures or which are chemically corrosive, heat exchangers must be constructed of materials designed not only to resist chemical corrosion but to remain stable at high temperatures. In such instances, metals or metal alloys have been replaced with materials such as carbon in its various forms, including graphite. This was done because graphite heat exchangers have a number of advantages which make them especially desirable for high temperature, high chemical corrosion uses. Graphite withstands thermal shock better than most metals and is quite resistant to chemical corrosion. However, there are certain disadvantages to graphite structures which heretofore have limited their use in heat exchangers. For instance, graphite is relatively brittle, so that tubes made of graphite are relatively fragile. This problem has been addressed by various support structures surrounding or laminated to or with the graphite material.

Whether prior heat exchangers have been made of metals, metal alloys or carbon, including graphite, the heat exchanger components heretofore have been fabricated as an isotropic structure, i.e. having the same physical properties in all directions. In other words, the thermal conduction was accomplished simply by the nature or substance of the material itself whether it be metal, graphite or other thermal conductive materials.

This invention is directed to a novel heat exchanger utilizing graphite material, or the like, in which the graphite is fabricated of a fibrous composite having improved thermal conduction characteristics.

SUMMARY OF THE INVENTION

An object of the invention, therefore, is to provide a new and improved heat exchanger using a graphite composite as the thermal conducting medium.

Another object of the invention is to provide a heat exchanger with heat exchanging means in the form of a composite of thermally conductive fibers.

In the exemplary embodiment of the invention, a heat exchanger is disclosed with means defining a first flow path for passing a heated fluid therethrough and a second flow path for passing a cooling medium therethrough. Heat exchanging means extend between the first and second flow paths in communication therewith. The heat exchanging means include a composite of thermally conductive fibers laid up unidirectionally in a direction between the flow paths for transferring heat from the fluid in the first flow path for absorption by the cooling medium in the second flow path.

Preferably, the thermally conductive fibers are composed of graphite material such as a highly crystalline graphite. The fibers are held together by a bonding matrix, such as an epoxy resin material including thermally conductive filler material.

The fibrous composite is illustrated in the form of a plurality of flat wafer-like composite constructions extending between the flow paths, generally parallel to the flow of the heated fluid and cooling medium, whereby the flow pattern is between the flat composites. It is contemplated that the flat composite may be corrugated to define channels of increased surface areas extending in the direction of the flow of the heated liquid and cooling medium.

The heat exchanging means described above are illustrated herein as embodied in a heat exchanger having a first chamber for flowing the heated fluid therethrough and a second chamber for flowing the cooling medium therethrough. A plurality of flat composites extend between the chambers and supporting gasket means are disposed between the composites for maintaining spacing therebetween and defining common wall means between the two chambers.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view, partially cut away, of a heat exchanger embodying the heat exchanging means of the invention;

FIG. 2 is a vertical section taken generally along line 2—2 of FIG. 1, with the heat exchanging means removed to illustrate the interior of the chambers;

FIG. 3 is a horizontal section taken generally along line 3—3 of FIG. 2; and FIG. 4 is a perspective view, on an enlarged scale, of a single flat heat exchanging composite of the invention, sandwiched between a pair of spacing gaskets.

DETAILED DESCRIPTION OF THE PREFERRED EMBODIMENT

Referring to the drawings in greater detail, and first to FIG. 1, the invention contemplates usage in a variety of heat exchanger configurations, one of which is illustrated in the drawings and generally designated 10. The exchanger includes a generally rectangular housing 12 defining first and second chambers 14 and 16, respectively, Of course, it should be understood that the configuration of heat exchanger 10 is only one of a wide range of configurations and/or applications with which the invention is equally applicable.

Referring to FIGS. 2 and 3 in conjunction with FIG. 1, an inlet 18 and an outlet 20 are provided to and from first chamber 14, at opposite ends. Similarly, an inlet 22 and an outlet 24 are provided to and from chamber 16. Baffle means, generally designated 26, are provided immediately inside inlets 18 and 22. The baffle means are in the form of a grid-like pattern of panels 28 (FIG. 3) which diverge with respect to each other and the surrounding walls of housing 12 in order to distribute incoming fluid substantially evenly over the entire cross-sectional area of chambers 14 and 16.

In essence, first chamber 14 defines a first flow path for passing a heated fluid therethrough from inlet 18 through outlet 20. Likewise, second chamber 16 defines a second flow path for passing a cooling medium therethrough from inlet 22 through outlet 24.

Generally, the invention comprehends providing heat exchanging means extending between the first and second flow paths (i.e. first and second chambers 14 and 16, respectively) in communication therewith for transferring heat from the heated fluid in the first flow path through chamber 14 for absorption by the cooling medium passing through the second flow path in chamber 16.

More particularly, referring to FIG. 4, the heat exchanging means include at least one composite, generally designated 30, of thermally conductive fibers 32 laid up undirectionally in a direction between the flow paths through chambers 14,16.

Although certain ceramics or metals might be used as the thermally conductive fibers for fabricating composite 28, the invention preferably contemplates the use of a graphite material such as a highly crystalline graphite. The graphite fibers are held together by a bonding matrix such as an epoxy resin material. Preferably, the bonding matrix includes a thermally conductive material, such as including a thermally conductive filler material in the epoxy resin.

Furthermore, FIG. 4 shows each heat exchanging composite 28 to be laid up in a generally flat construction which, as described below, is intended to extend between the flow paths through chambers 14,16 generally parallel to the flow of the heated fluid and cooling medium through those respective chambers. However, it is contemplated that the flat composite could be corrugated to define channels of increased surface areas extending in the direction of the flow paths.

Referring back to FIG. 1 in conjunction with FIG. 4, it can be seen that a plurality of the flat composites 30 of unidirectionally extending, thermally conductive fibrous material are positioned in generally parallel spaced relationship within housing 12 of heat exchanger 10. The heated fluid flowing through chamber 14 and the cooling medium flowing through chamber 16 pass through the spacing 36 defined between the spaced, parallel composites 30. A plurality of bar-like gaskets 38 are positioned between the heat exchanging composites 30 intermediate the ends thereof to define common wall means between chambers 14 and 16. Therefore, the gaskets not only space and properly position the heat exchanging composites, but the gaskets themselves define the divider means or wall means to separate the chambers defining the flow paths for the heated fluid and the cooling medium.

Since the fibers of composites 30 are laid up unidirectionally in the direction of double-headed arrow 40 (FIG. 4), a much more efficient heat exchanging means is provided between the two flow paths than by using conventional isotropic material, whether it be graphite, metal, ceramic or the like.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A heat exchanger, comprising:

means defining a first flow path for passing a heated fluid therethrough;

means defining a second flow path for passing a cooling medium therethrough; and heat exchanging means extending across both the first and second flow paths, including a composite of thermally conductive fibrous material layed up unidirectionally in a direction between the flow paths for transferring heat from the heated fluid in the first flow path for absorption by the cooling medium in the second flow path.

2. The heat exchanger of claim 1 wherein said thermally conductive fibers are composed of graphite material.

3. The heat exchanger of claim 2 wherein said thermally conductive fibers are of highly crystalline graphite.

4. The heat exchanger of claim 2 wherein said graphite fibers are held together by a bonding matrix.

5. The heat exchanger of claim 4 wherein said bonding matrix is of an epoxy resin material.

6. The heat exchanger of claim 5 wherein said epoxy resin material includes a thermally conductive filler material.

7. The heat exchanger of claim 1 wherein said fibers are held together by a bonding matrix including a thermally conductive material.

8. The heat exchanger of claim 1 wherein said composite of unidirectional, thermally conductive fibers are layed up in a generally flat construction extending between the flow paths and generally parallel to the flow of the heated fluid and cooling medium therethrough.

9. The heat exchanger of claim 8, including a plurality of said flat composites extending between the flow paths in generally parallel spaced relationship.

10. A heat exchanger, comprising:

a first chamber for flowing a heated fluid therethrough;

a second chamber for flowing a cooling medium therethrough; and a generally flat composite extending across both the first and second chambers with the heated fluid and cooling medium flowing therethrough and oriented generally parallel to said flow, the composite being fabricated of thermally conductive fibers layed up unidirectionally in the direction between the chambers for transferring heat from the fluid in the first chamber for absorption by the cooling medium in the second chamber.

11. The heat exchanger of claim 10, including a plurality of said flat composites extending between the flow paths in generally parallel spaced relationship.

12. The heat exchanger of claim 11, including supporting gasket means between the composites for maintaining said spacing.

13. The heat exchanger of claim 12 wherein said chambers are divided by common wall means defined by said supporting gasket means.

14. The heat exchanger of claim 10 wherein said thermally conductive fibers are composed of graphite material.

15. The heat exchanger of claim 14 wherein said thermally conductive fibers are of highly crystalline graphite.

16. The heat exchanger of claim 14 wherein said graphite fibers are held together by a bonding matrix.

17. The heat exchanger of claim 16 wherein said bonding matrix is of an epoxy resin material.

18. The heat exchanger of claim 17 wherein said epoxy resin material includes a thermally conductive filler material.

19. The heat exchanger of claim 10 wherein said fibers are held together by a bonding matrix including a thermally conductive material.

* * * * *